US006172300B1

(12) United States Patent
Kawaguchi

(10) Patent No.: US 6,172,300 B1
(45) Date of Patent: Jan. 9, 2001

(54) SUPPORT STRUCTURE FOR CONNECTING SECTIONS OF WIRE HARNESSES

(75) Inventor: Kiyofumi Kawaguchi, Yokkaichi (JP)

(73) Assignee: Sumitomo Wiring Systems, Ltd. (JP)

( * ) Notice: Under 35 U.S.C. 154(b), the term of this patent shall be extended for 0 days.

(21) Appl. No.: 09/261,295

(22) Filed: Mar. 2, 1999

(30) Foreign Application Priority Data

Mar. 4, 1998 (JP) ..... 10-052124

(51) Int. Cl.[7] ..... H01R 13/46

(52) U.S. Cl. ..... 174/59; 174/35 C; 174/135; 439/910

(58) Field of Search ..... 174/59, 52.1, 52.4, 174/52.6, 135, 35 C; 439/910

(56) References Cited

U.S. PATENT DOCUMENTS

| | | | | |
|---|---|---|---|---|
| 3,033,913 | * | 5/1962 | Dietze | 174/60 |
| 3,564,486 | * | 2/1971 | Price | 439/625 |
| 3,610,810 | * | 10/1971 | Fribley | 174/59 |
| 4,864,078 | * | 9/1989 | Bowman | 174/48 |
| 5,936,200 | * | 8/1999 | Park | 174/59 |
| 5,939,673 | * | 8/1999 | Rentmore | 174/59 |
| 5,986,210 | * | 11/1999 | Kummle et al. | 174/59 |
| 6,027,367 | * | 2/2000 | Woertz et al. | 439/497 |

FOREIGN PATENT DOCUMENTS

1258470 * 12/1971 (GB) ..... 174/59

OTHER PUBLICATIONS

JP Patent Unexamined Publication No. 9–22743 Jan. 1997.

* cited by examiner

*Primary Examiner*—Kristine Kincaid
*Assistant Examiner*—Dhiru R Patel
(74) *Attorney, Agent, or Firm*—Bierman, Muserlian and Lucas

(57) ABSTRACT

A structure for securing electrical contact between connecting sections of a wire harness includes a wall with a hole therethrough and a projection having a hollow. The projection extends from a rim of the hole and the hollow is in communication therewith. There is a cover which closes the end of the projection remote from the rim. There is a plurality of connecting sections on one or more wire harnesses and an insulative cap is placed thereover. The hollow is adapted to receive the cap and connection sections and an opening is provided in the cover. This permits introduction of a resilient cap, which will secure the connecting sections within the hollow and allows otherwise trapped air to escape readily through the opening. This simplifies both production and assembly.

10 Claims, 2 Drawing Sheets

SUPPORT STRUCTURE FOR CONNECTING SECTIONS OF WIRE HARNESSES

This Application claims the benefit of the priority of Japanese 10-52124, filed Mar. 4, 1998.

The present Invention is directed to a support structure for making secure electrical contact between connecting sections of wire harnesses, particularly those used in automotive vehicles such as cars and trucks.

BACKGROUND OF THE INVENTION

A prior art device of the general type referred to herein is shown in FIG. 4. Connection box 11 is provided with projection 12 extending from bottom wall 11*a* thereof. Connecting sections 13*a* of main line 13 are inserted into the hollow portion of projection 12. Support hook 14 holds connecting sections 13*a* within the hollow and prevents them from falling out. However, this configuration suffers from certain defects. During assembly, connecting sections 13*a* are inserted into the interior of projection 12. However, since the connecting sections are hidden inside the projection, it cannot be determined if connecting sections 13*a* have been pushed too far in and are impacting against the inner wall of the projection. Alternatively, if connecting sections 13*a* have not been inserted far enough, this also cannot be determined readily by observation. The result of the latter will be unstable contacts.

SUMMARY OF THE INVENTION

The present Invention is intended to overcome the foregoing deficiencies of the prior art and provide a connection box wherein the connecting sections of the wire harness can be inserted readily and reliably into the hollow projection. The inventive structure for securing electrical contact between connecting sections of the wire harness has a wall with a hole therethrough. A projection with a hollow therein extends from the rim of the hole and communicates therewith. A cover closes the end of the projection remote from the rim.

There is also provided a wire harness having a plurality of connecting sections with an insulative cap placed thereover. The combination of the cap and connecting sections is inserted into the hollow which is provided with an opening through its cover. Preferably, the projection extends inwardly of the structure and is of circular cross section. Also, the opening is desirably circular. It is also preferred that the cap is resilient and is slightly larger in diameter than the internal diameter of the hollow. Thus, when the cap is inserted into the hollow, it bears against the inner wall thereof and is secured, along with the contact sections, therein. Advantageously, the cap is waterproof.

BRIEF DESCRIPTION OF THE DRAWINGS

In the accompanying drawings, constituting a part hereof, and in which like reference characters indicate like parts.

DETAILED DESCRIPTION OF THE INVENTION

Figure 1:
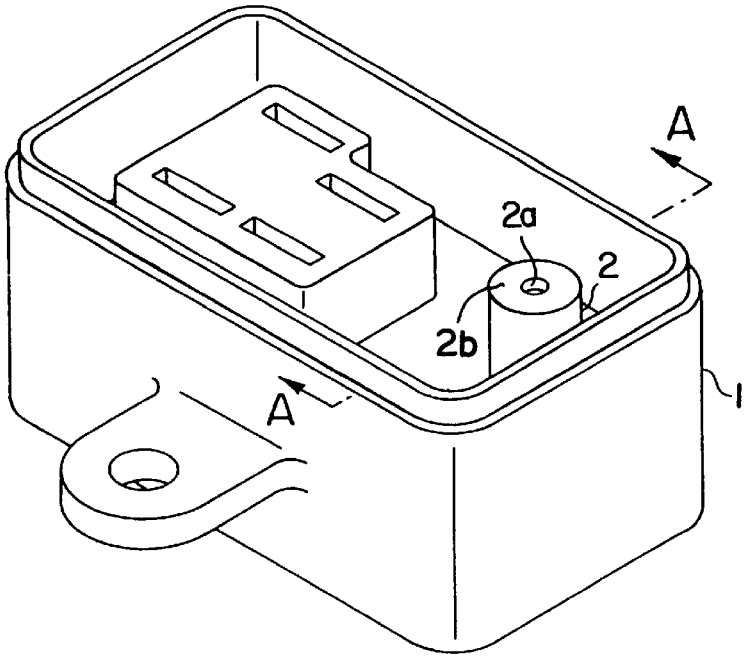
FIG. 1 is a perspective view of a connection box in accordance with the present Invention.
Figure 2:
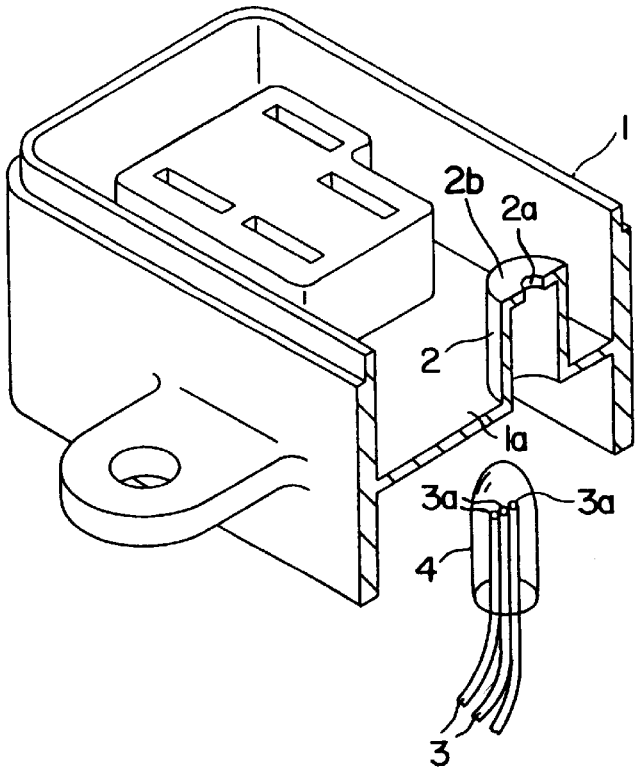
FIG. 2 is a view, similar to that of FIG. 1, partly in section along line A—A.
Figure 3:
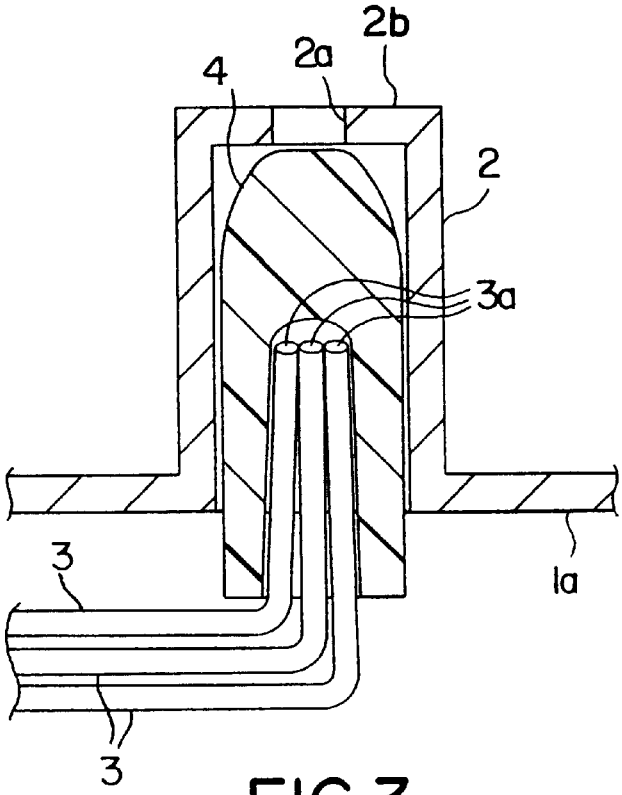
FIG. 3 is an enlarged view, partly in section, showing the cap and wire harnesses within the projection.
Figure 4:
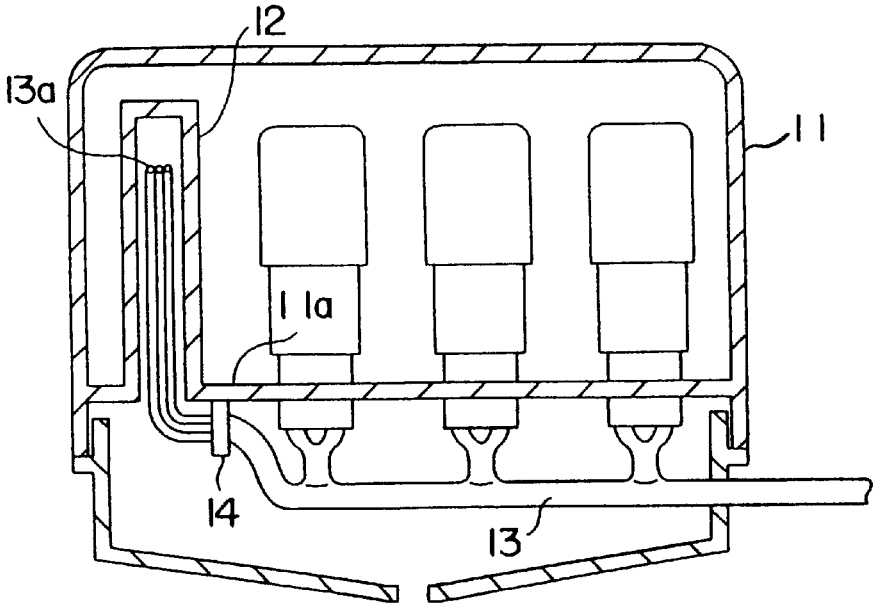
FIG. 4 PRIOR ART
FIG. 4 is a view, partly in section, of a prior art connection box.

As shown in FIGS. 1 to 3, connection box 1 is provided with projection 2 upstanding from bottom wall 1*a*. Connection sections 3*a* of main lines 3 of the wire harnesses are encased by resilient cap 4. Projection 2 has opening 2*a* in cover 2*b*.

As particularly shown in FIG. 3, cap 4 and sections 3*a* are forced into the hollow of projection 2. The resilience of cap 4 enables it to bear against the inner walls of projection 2, thereby securing the cap and the connection sections therein.

This structure provides a number of important advantages. The opening in the cover of the projection permits the assembler to observe the cap and connection sections of the wire harness as they are being installed. In this way, it can be assured that the cap and sections are inserted properly. Undue forcing and insufficient insertion are thereby eliminated.

Moreover, since the cap may be resilient, this characteristic permits it to grip the inside of the projection and thereby be retained therein. This eliminates the need for the hook used in the prior art.

The opening in the cover performs a further function. Since the cap will fit snugly within the hollow, the opening provides a ready exit for air which would otherwise be trapped therein. In addition, by making the cap waterproof, the connection sections are further protected.

The projection can be formed integrally with the bottom wall of the connection box, thereby simplifying both the construction and the assembly thereof. If the opening is circular, it can be more easily formed. Also, it is possible to form the connecting sections efficiently by the use of resistance welding.

Although only a limited number of aspects of the present Invention have been expressly disclosed, such modifications as would be apparent to the person of ordinary skill may be made without departing from the scope or spirit thereof. For example, there are other processes to connect the connection sections and they may be used in place of resistance welding. While it is desirable to form the bottom wall of the connection box integrally with the projection, it is also feasible to have these two elements as separate members adhered together.

The present Invention teaches that the projection has a circular cross section. However, other hollow cross sections are possible, so long as an opening-is provided in the cover and the degree of insertion of the connection sections can be readily ascertained.

Although the Invention has been expressly disclosed with regard to one embodiment, it is, nonetheless, to be broadly construed, and not to be limited except by the character of the claims appended hereto.

What we claim is:

1. A structure for securing electrical contact between connecting sections of a wire harness comprising a wall of said structure with a hole therethrough, a projection having a hollow, said projection extending from a rim of said hole with said hollow in communication therewith, a cover closing an end of said projection remote from said rim;

a wire harness having a plurality of said connecting sections, an insulative cap on said connecting sections, said hollow adapted to receive said cap and said connecting sections, there being an opening in said cover.

2. The structure of claim 1 wherein said projection extends inwardly of said structure.

3. The structure of claim 1 wherein said projection is substantially circular in cross section parallel to said wall.

4. The structure of claim 1 wherein said opening is circular.

5. The structure of claim 1 wherein said cap is resilient and has an outer diameter greater than that of said hollow whereby, when said cap is inserted into said hollow, an outer surface of said cap bears against an inner surface of said projection.

6. The structure of claim 5 wherein said cap is waterproof.

7. The structure of claim 1 wherein said projection is substantially perpendicular to said wall.

8. The structure of claim 1 wherein said projection is integral with said structure.

9. The structure of claim 1 wherein said wall is a bottom wall of said structure.

10. The structure of claim 1 wherein said connecting sections are resistance welded.

* * * * *